US007817049B2

(12) United States Patent
Müller et al.

(10) Patent No.: US 7,817,049 B2
(45) Date of Patent: Oct. 19, 2010

(54) COMBINED SCATTERED-LIGHT AND EXTINCTION-BASED FIRE DETECTOR

(75) Inventors: Kurt Müller, Männedorf (CH); Peter Steiner, Jona (CH)

(73) Assignee: Siemens AG, Munich (DE)

( * ) Notice: Subject to any disclaimer, the term of this patent is extended or adjusted under 35 U.S.C. 154(b) by 341 days.

(21) Appl. No.: 12/089,789

(22) PCT Filed: Nov. 2, 2006

(86) PCT No.: PCT/EP2006/068036

§ 371 (c)(1),
(2), (4) Date: Apr. 10, 2008

(87) PCT Pub. No.: WO2007/051820

PCT Pub. Date: May 10, 2007

(65) Prior Publication Data

US 2008/0211681 A1 Sep. 4, 2008

(30) Foreign Application Priority Data

Nov. 4, 2005 (EP) ..... 05110341

(51) Int. Cl.
*G08B 17/10* (2006.01)

(52) U.S. Cl. ..... 340/630

(58) Field of Classification Search ..... 340/628, 340/286.05, 578, 630, 555, 577; 250/574
See application file for complete search history.

(56) References Cited

U.S. PATENT DOCUMENTS

| | | | | | |
|---|---|---|---|---|---|
| 4,288,790 | A * | 9/1981 | Schnell | 340/628 |
| 4,930,095 | A * | 5/1990 | Yuchi et al. | 702/87 |
| 5,225,810 | A | 7/1993 | Inoue et al. | |
| 5,381,130 | A * | 1/1995 | Thuillard et al. | 340/630 |
| 5,451,931 | A * | 9/1995 | Muller et al. | 340/630 |
| 5,502,434 | A | 3/1996 | Minowa et al. | |
| 5,872,634 | A * | 2/1999 | Kunz | 356/438 |
| 6,111,511 | A * | 8/2000 | Sivathanu et al. | 340/577 |
| 6,788,197 | B1 * | 9/2004 | Thuillard et al. | 340/522 |
| 2002/0080040 | A1 | 6/2002 | Schneider et al. | |
| 2002/0153499 | A1 * | 10/2002 | Oppelt et al. | 250/559.16 |
| 2003/0020617 | A1 | 1/2003 | Tice et al. | |

FOREIGN PATENT DOCUMENTS

EP 0472039 A2 2/1992

OTHER PUBLICATIONS

English translation of Chinese Office Action dated Jul. 10, 2009.

* cited by examiner

*Primary Examiner*—Phung Nguyen
(74) *Attorney, Agent, or Firm*—Laurence A Greenberg; Werner H Stemer; Ralph E Locher

(57) ABSTRACT

A fire detector has at least two sensor units for monitoring a confined space for the occurrence of a fire. A first fire parameter is monitored according to the scattered light method, using a first sensor unit located at or in the vicinity of the ceiling. At least one second sensor unit of the fire detector, which emits at least two highly focused light beams towards the floor of the confined space, monitors a second fire parameter according to the extinction method.

25 Claims, 1 Drawing Sheet

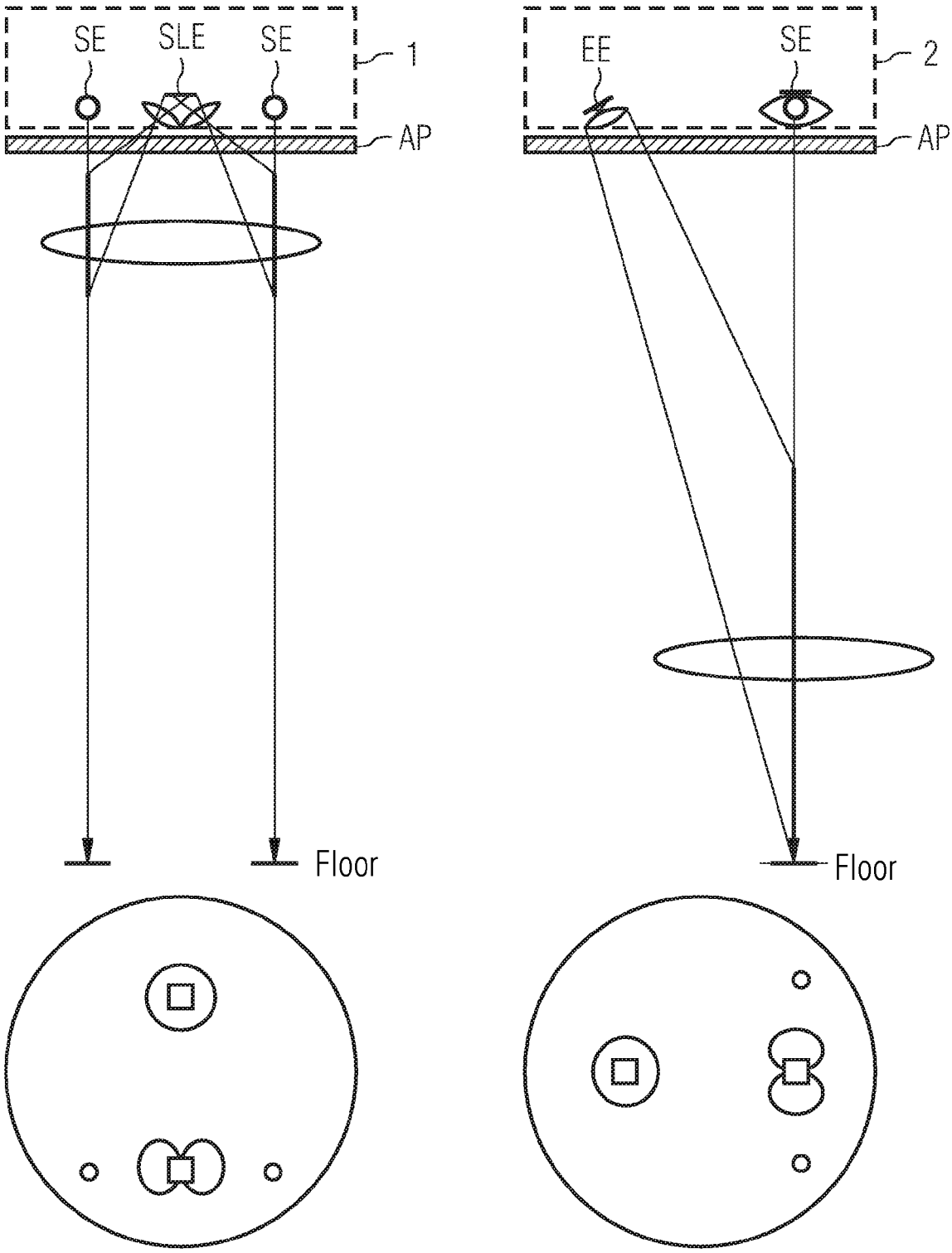
SE
SLE
SE
1
AP
Floor
EE
SE
2
AP
Floor

COMBINED SCATTERED-LIGHT AND EXTINCTION-BASED FIRE DETECTOR

CROSS-REFERENCE TO RELATED APPLICATIONS

This application is a §371 national stage of international application PCT/EP2006/06836, filed Nov. 2, 2006; the application claims the priority of European patent application EP 05110341.4, filed Nov. 4, 2005; the prior applications are herewith incorporated by reference in their entirety.

BACKGROUND OF THE INVENTION

Field of the Invention

The invention relates to a method for detecting a fire by means of a fire detector that includes at least two sensor units and monitors a structurally limited space, by which method a first fire characteristic is monitored by means of a first sensor unit of the fire detector according to the scattered-light method.

Conventional point-type detectors such as, for instance, what are termed scattered-light detectors perform measuring virtually without exception in a darkened measuring chamber, referred to as the labyrinth. Disruptive influencing due to light is greatly reduced thereby. The receiver diode's quiescent current and the noise associated therewith are also minimized. The labyrinth has, though, perforce the disadvantage that smoke can penetrate only with a delay and that its density inside the labyrinth will at best asymptotically attain the value of the concentration outside. Any fire will consequently be detected correspondingly late.

The smoke's density generally reduces sharply toward the ceiling in high-ceilinged spaces. Depending on the fire's energy and the ceiling height, the greatest concentration can be far from the ceiling. Any fire can therefore be detected by conventional point-type detectors only with a delay.

The scattered-light method can be applied also outside a darkened measuring chamber in the space being monitored. The number of disruptive influences from the surrounding area will, though, be significantly higher with such an application. Thus insects, for example, that enter the measuring zone or any accidental covering during, say, cleaning need to be reliably distinguishable from a fire or, as the case may be, smoke. Attempts to resolve disadvantages of said kind generally consist in limiting measuring or, as the case may be, monitoring to the fire detector's immediate vicinity. A distance of 4 to 10 cm from the fire detector's surface is generally considered typical in that regard. The extent to which the disadvantages can be reduced thereby is unfortunately only limited.

Linear smoke detectors send a light beam across the space being monitored and will trigger an alarm if the beam is attenuated by smoke (extinction). It is irrelevant in this case whether the sender and receiver are located in separate devices on opposite walls of the space or combined in a single unit. In the case of a single unit a reflector will then be required on the opposite wall. The measuring path being as a rule several meters in length, linear detectors are generally more sensitive than scattered-light detectors. In high-ceilinged spaces they can, moreover, be positioned at a height at which smoke can still be expected. It is with such arrangements naturally far more probable that the light beam will be influenced or even interrupted than if the beam is effective only in the detector's ambient area.

BRIEF SUMMARY OF THE INVENTION

The object of the present invention is to be seen in proposing a simple and efficient way of detecting a fire as early as possible.

Said object is inventively achieved in each case by means of the subject matter of the independent claims. Developments of the invention are disclosed in the dependent claims.

An essential aspect of the invention is to be seen in employing for a fire's earliest possible detection a fire detector having a first sensor unit for monitoring a first fire characteristic according to the scattered-light method and a second sensor unit for monitoring a second fire characteristic according to the extinction method. The first sensor unit consists inventively of at least one light-emitting transmitting unit and at least one receiving unit that receives the emitted light. The second sensor unit consists of at least two transmitting units emitting intensely bundled light and at least one receiving unit that receives the emitted light. The signals of the fire detector's two sensor units can be evaluated either individually or in combination by a suitable evaluation unit such as, for example, a fuzzy processor. The fire detector is therein generally mounted on the ceiling of the structurally limited space. The two sensor units can in part use the same components. That means the at least two transmitting units emitting the intensely bundled light beams can be used jointly by both sensor units. An IR laser diode or IR diode etc. can inventively be used for transmitting units of said kind. The receiving units can then forward the received signals to an evaluation unit, provided therefor, of the fire detector. The intensely bundled light beams emitted by the at least two transmitting units are directed from the ceiling toward the floor and can therein be either parallel or slightly (outwardly) inclined. The angle of inclination is generally less than 10 degrees. Smoke in the immediate vicinity of the fire detector is detected by means of the scattered-light method and extinction method; smoke that is further from the ceiling is detected only by means of the extinction method because the scattered light is too weak. To obtain an assignment of the measuring signals to one of the emitted light beams, the transmitting units are driven temporally displaced and the light beams hence emitted temporally displaced. Distance measuring will provide information on whether, in the event of a level change, a partially reflecting object extending in the direction of the height of the space is involved. It can then be assumed that an object disrupting the measurement is located between the "normal" reflection site, the location within the space at which monitoring of the second fire characteristic inventively takes place, and the fire detector within the space. If that is the case, then adverse influencing by living things (people, animals etc.) or moving objects can generally be inferred. Distance measuring can be performed with the aid of, for example, the principle disclosed in EP 1391860 A1. Relative distances of a few centimeters can be registered sufficiently fast using said principle. For monitoring the second fire characteristic the receive signals assigned to the individual transmitting units are mutually correlated taking the temporal displacement in sending into account. A strong correlation in terms of time curve and level accompanied by a typical course will characterize smoke or, as the case may be, a fire, as that will exhibit no appreciable local differences in concentration within the distance between the two emitted beams. Receive signals arising owing to changed reflection due to moving objects can be distinguished additionally through the signals' temporal sequence. Large or, as the case may be, long objects will affect a plurality of light beams, whereas in the case of objects that are smaller than the distances between beams (insects, for instance) there will always be a temporal displacement for all received signals so that false alarms can be avoided. To further reduce the risk of a false alarm, an alarm can be triggered only if a fire is detected in accordance with both the scattered-light method and the extinction method.

It is a major advantage of the inventive method that a fire can be detected or identified significantly earlier. Hence a fire alarm can then also be triggered earlier and risks of material damage and personal injury consequently minimized.

Another major advantage of said inventive fire detector is that it can be integrated in the ceiling covering of a space and will hence be flush with the ceiling.

The invention is explained in more detail with reference to an exemplary embodiment shown in FIG. 1.

BRIEF DESCRIPTION OF THE DRAWING

The FIGURE is a schematic view of a fire detector with two sensor units according to the invention.

DESCRIPTION OF THE INVENTION

FIG. 1 shows a fire detector having two inventive sensor units 1, 2 and a cover plate AP. Windows or openings for the receiving units SLE and EE and for the transmitting units SE are indicated for the cover plate AP shown, which can be made of plastic, metal, wood, glass etc. Said fire detector can be integrated in the ceiling of a space. The cover AP of the fire detector can then be flush with the ceiling or else project slightly. The thick black lines indicate the respective measuring zone. Although for greater clarity shown mutually separated, both sensor units 1, 2 are intended to be inventively integrated in one fire detector and at least the transmitting units SE are intended to be used jointly by both sensor units 1, 2. The first sensor unit 1 consists of two light-emitting transmitting units SE and one scattered-light receiving unit SLE. The scattered-light receiving unit SLE is oriented by means of two sets of optics in such a way as only to register a section or, as the case may be, measuring zone of the beams that is near the ceiling. Said sections extend thanks to beam bundling only in the direction of the beam axes, which is important for distinguishing between disruptive objects and smoke or, as the case may be, a fire. If smoke spreads within one or more of the illustrated beam sections, then the scattered light will increase in line with the development of smoke density characterizing a specific type of fire. Owing to spatial proximity to the fire detector the increase in the development of smoke density is correlated midway in the course. If an object such as, for instance, an insect or cleaning implement etc. enters one of the beam sections, then thanks to the extremely small inventive beam cross-section a signal jump will always be measured that differs significantly from a signal produced by smoke. The second sensor unit 2 consists of the same two transmitting units SE and one extinction receiving unit EE. The extinction receiving unit EE detects smoke according to the extinction method. By means of its optics, the extinction receiver EE for that purpose maps a zone that is further from the ceiling, embraces all emitted light beams and is situated outside the zone monitored using the scattered-light method. What is mapped are the points of impact of the transmitting units SE on the floor or on objects approximately 2 to 5 meters from the ceiling. The emitted light beams' reflection on the floor or possibly on items of furniture such as tables, shelving etc. is registered thereby up to a ceiling height of, for instance, 5 meters.

In undisrupted surroundings, meaning if the emitted light beams reach the floor unimpeded, the reflected light will be measured. The emitted light beams will penetrate any smoke layer at any height. That will result in not only reliable but as a rule also early smoke detection. Since the degree of reflection and distance are not known in advance, the inventive fire detector will adapt to the prevailing situation on power-on and subsequently also while in operation. Although just one emitted light beam could, of course, also be used for the inventive method, a significantly greater number of disruptive influences must then be expected.

The following measures and algorithms are employed for the inventive method so that false alarms can be minimized:

- Thanks to intense light-beam bundling, any interrupting of the beam will occur very rapidly and completely even if, for instance, a moving object is moving only very slowly. The speed of any level decrease will therefore differ significantly from that in the case of smoke formation.
- Distance measuring will provide information on whether, in the event of a level change, an at least partially reflecting object extending in the direction from the floor toward the ceiling of a structurally limited space is involved. If that is the case, then adverse influencing by a living thing (a person or animal etc.) or a moving object can generally be inferred. If, according to the inventive method, at least two transmitting units SE are used, then the receive signals assigned to the individual transmitting units SE will be correlated mutually and taking the temporal displacement in sending into account. A strong correlation in terms of time curve and level accompanied by a typical course will characterize smoke, as that will not exhibit extremely large local differences in concentration. Received signals due to changed reflection in the case of moving objects (living things, something moving) can, when there are a plurality of light beams, be additionally distinguished through the receive signals' temporal sequence. In the case of long and large objects two light beams can be influenced simultaneously. For objects such as, for example, insects etc. that are smaller than the distances between light beams there will always be a temporal displacement for all receive signals.

In the undisrupted condition, meaning if there are no living things or moving objects in the structurally limited space, the receive signals according to the scattered-light method and the receive signals according to the extinction method will be combined in such a way (neuro-fuzzy processor) that highly reliable information about the presence of a fire provided by one sensor system in conjunction with more probably unreliable information provided by the other will suffice to trigger a fire alarm. Said kind of triggering of a fire alarm will generally take place significantly earlier than will be the case with point-type detectors that operate only in accordance with the scattered-light method.

The received signals are generally forwarded by the receiving units SLE and EE to an evaluation unit such as, for example, a fuzzy processor for evaluation. If the evaluation indicates a possible fire, an alarm will be triggered. By way of example, the following conditions of the fuzzy processor's input variables characterize a fire:

- Extinction has increased significantly in the manner of the course of a fire although the distance between the fire detector and detection point has remained unchanged.
- A slight increase in scattered light indicates that first smoke has risen to the ceiling
- An alarm is triggered.

It will obviously be difficult under the adverse influence of moving objects to measure any development of smoke simultaneously by means of extinction. The signal changes due to the moving objects will be dominant. In this condition fire detection will rely more on monitoring according to the scattered-light method. It is acceptable for sensitivity to be somewhat reduced under those circumstances. The open scattered-light method, meaning the measuring of scattered light in surroundings near the fire detector, is superior to a classical point-type detector in terms of response speed because the smoke does not first have to penetrate a darkened space inside the fire detector.

The invention claimed is:

1. A method of detecting a fire with a ceiling-mounted fire detector monitoring a structurally limited space having a ceiling and a floor, the method which comprises:

monitoring a first fire characteristic in a close vicinity of the ceiling according to a scattered-light method with a first sensor unit;

monitoring a second fire characteristic according to an extinction method with at least one second sensor unit of the fire detector, by emitting at least two intensely bundled light beams toward the floor; and emitting the at least two light beams parallel or inclined at an angle of less than 10 degrees.

2. The method according to claim 1, which comprises monitoring the second fire characteristic according to the extinction method outside a zone monitored by the first sensor unit according to the scattered-light method.

3. The method according to claim 1, which comprises jointly using at least two transmitting units, each emitting an intensely bundled light beam, and at least one receiving unit for the first sensor unit and for the second sensor unit.

4. The method according to claim 1, which comprises monitoring the second fire characteristic in an open space between the ceiling and floor of the structurally limited space.

5. The method according to claim 1, which comprises emitting the at least two light beams from the at least two transmitting units of the second sensor unit with a temporal offset.

6. The method according to claim 1, wherein the step of monitoring the second fire characteristic includes measuring a distance between the second sensor unit emitting the at least two light beams and an object at least partially reflecting the emitted light beams.

7. The method according to claim 6, wherein the object is a living thing or a moving object.

8. The method according to claim 1, wherein the extinction method comprises evaluating reflected light of the emitted light beams.

9. The method according to claim 8, wherein the step of monitoring the second fire characteristic includes associating reflected light beams received by the second sensor unit with the at least two emitted light beams and evaluating the reflected light beams in terms of a temporal curve and/or level thereof.

10. The method according to claim 9, wherein the step of associating the reflected light beams includes taking a temporal offset between the emitted light beams into account.

11. The method according to claim 9, which comprises triggering a fire alarm with the fire detector only if the temporal curve and/or the level correspond.

12. The method according to claim 8, wherein the step of monitoring the second fire characteristic includes associating reflected light beams received by the second sensor unit with the at least two emitted light beams and thereby taking into account a temporal offset between the emitted light beams.

13. The method according to claim 8, which comprises measuring a distance of the fire detector from an object reflecting the at least two emitted light beams, and triggering a fire alarm only if the distance from the object reflecting the at least two emitted light beams remains constant.

14. The method according to claim 8, which comprises triggering a fire alarm with the fire detector only if the first sensor unit monitoring the first fire characteristic detects a fire and the reflected light of the emitted light beams indicates a fire.

15. The method according to claim 1, which comprises laser light as the intensely bundled light beams.

16. The method according to claim 1, wherein the at least two emitted light beams are inclined outward.

17. The method according to claim 16, which comprises setting the angle of inclination to less than 10 degrees.

18. A fire detector for monitoring a structurally limited space having a ceiling and a floor and for detecting a fire, comprising:

a cover plate for covering the fire detector at least partially integrated in the ceiling of the structurally limited space;

a first sensor unit for monitoring a first fire characteristic according to the scattered-light method; and at least one second sensor unit emitting at least two intensely bundled light beams toward the floor of the structurally limited space for monitoring a second fire characteristic according to the extinction method, said at least two light beams being parallel to one another or inclined at an angle of less than 10 degrees.

19. The fire detector according to claim 18, which comprises at least two transmitting units for emitting at least two intensely bundled light beams provided jointly for said first sensor unit and said second sensor unit.

20. The fire detector according to claim 19, wherein said transmitting units include an IR laser diode.

21. The fire detector according to claim 19, wherein said transmitting units include an IR diode.

22. The fire detector according to claim 18, which comprises one receiving unit each in said first sensor unit and said second sensor unit for receiving reflections of the intensely bundled light beams emitted by said at least two transmitting units.

23. The fire detector according to claim 22, which comprises an evaluation unit for evaluating the light beams received by said receiving unit and for triggering an alarm.

24. The fire detector according to claim 23, wherein said evaluation unit includes a fuzzy processor.

25. The fire detector according to claim 18, which comprises a housing commonly housing said first sensor unit and said at least one second sensor unit, with said cover plate forming a cover lid of said housing.

* * * * *